US009908171B2

(12) United States Patent
Faitel

(10) Patent No.: US 9,908,171 B2
(45) Date of Patent: Mar. 6, 2018

(54) LINKAGE PRESS MACHINE

(71) Applicant: BTM Company LLC, Marysville, MI (US)

(72) Inventor: William M. Faitel, Marysville, MI (US)

(73) Assignee: BTM Company LLC, Marysville, MI (US)

( * ) Notice: Subject to any disclaimer, the term of this patent is extended or adjusted under 35 U.S.C. 154(b) by 0 days.

(21) Appl. No.: 15/297,463

(22) Filed: Oct. 19, 2016

(65) Prior Publication Data

US 2017/0144214 A1 May 25, 2017

Related U.S. Application Data

(60) Provisional application No. 62/259,697, filed on Nov. 25, 2015.

(51) Int. Cl.

| | |
|---|---|
| ***B21D 5/02*** | (2006.01) |
| ***B21J 7/32*** | (2006.01) |
| ***B21J 7/02*** | (2006.01) |
| ***B21D 5/01*** | (2006.01) |

(52) U.S. Cl.
CPC *B21J 7/32* (2013.01); *B21D 5/01* (2013.01); *B21D 5/02* (2013.01); *B21J 7/02* (2013.01)

(58) Field of Classification Search
CPC ..... B21D 5/02; B21D 5/01; B21J 7/02; B21J 7/32
USPC ..... 72/390.4, 390.5, 450; 100/272
See application file for complete search history.

(56) References Cited

U.S. PATENT DOCUMENTS

| | | | | |
|---|---|---|---|---|
| 1,422,779 | A * | 7/1922 | Perony | B21D 5/01 248/314 |
| 2,224,968 | A | 12/1940 | Klocke | |
| 3,529,502 | A | 9/1970 | Krynytzky | |
| 3,763,690 | A * | 10/1973 | Kirincic | B21D 5/02 100/258 A |
| 3,805,694 | A | 4/1974 | Jureit et al. | |
| 3,869,927 | A | 3/1975 | Lose et al. | |
| 3,935,778 | A | 2/1976 | Pretty | |
| 4,070,896 | A * | 1/1978 | Heitner | B21D 5/02 72/389.5 |
| 4,104,962 | A | 8/1978 | Castillo | |
| 4,165,685 | A | 8/1979 | Nakada et al. | |
| 4,856,316 | A | 8/1989 | Slasinski | |
| 4,878,284 | A | 11/1989 | Sawdon | |

(Continued)

OTHER PUBLICATIONS

"Joining Metals with Stamping Dies," www.BTMcorp.com, published Oct. 26, 2015, 8 pages.

(Continued)

*Primary Examiner* — David B Jones
(74) *Attorney, Agent, or Firm* — Harness, Dickey & Pierce, PLC

(57) ABSTRACT

A press machine includes at least one actuator and at least one linkage to open and close a ram. Another aspect employs a sheet metal-working punch mounted to the ram. A fluid-powered piston drives a carriage coupled to a linkage in another aspect of the present machine. In still another aspect, at least a majority of an actuator is located externally to an outside surface of a stationary structure within which a ram is located. Yet a further aspect both opens and closes a ram with a unidirection movement of an actuator.

42 Claims, 9 Drawing Sheets

(56) References Cited

U.S. PATENT DOCUMENTS

| | | | | |
|---|---|---|---|---|
| 4,920,782 | A | 5/1990 | Hellwig | |
| 5,279,197 | A | 1/1994 | Takeda et al. | |
| 5,289,096 | A | 2/1994 | Takeda | |
| 5,306,136 | A | 4/1994 | Oomori et al. | |
| 5,791,241 | A | 8/1998 | Levy | |
| 5,799,573 | A | 9/1998 | Levy | |
| 6,012,370 | A | 1/2000 | Kobayashi | |
| 6,041,699 | A | 3/2000 | Seto et al. | |
| 6,082,255 | A | 7/2000 | Gundal et al. | |
| 6,092,270 | A | 7/2000 | Sawdon | |
| 6,115,898 | A | 9/2000 | Sawdon | |
| 6,401,513 | B1 * | 6/2002 | Fritsch | B21D 5/02 100/272 |
| 6,510,786 | B1 | 1/2003 | Harsch | |
| 6,619,088 | B1 | 9/2003 | Oyamada et al. | |
| 6,820,455 | B1 | 11/2004 | Bainter | |
| 7,187,996 | B2 | 3/2007 | Tanaka et al. | |
| 7,353,685 | B2 | 4/2008 | Martin et al. | |
| 7,685,925 | B2 | 3/2010 | Sawdon et al. | |
| 7,694,399 | B2 | 4/2010 | Sawdon et al. | |
| 7,810,368 | B2 | 10/2010 | Rusch | |
| 8,065,956 | B2 | 11/2011 | Bussert et al. | |
| 8,881,364 | B2 | 11/2014 | Sawdon et al. | |
| 2002/0157442 | A1 | 10/2002 | Petersen | |

OTHER PUBLICATIONS

"Caged Ball LM Guide," THK Co., Ltd., Tokyo, Japan, Catalog No. 235-13E, Nov. 3, 2007, 24 pages.

"Hydraulic and Mechanical Presses," www.thelibraryofmanufacturing.com, Nov. 23, 2015, 6 pages.

Cattell, Dennis, "Stamping 101: Anatomy of a Mechanical Press," www.thefabricator.com, Nov. 23, 2015, 6 pages.

"Air Powered Toggle Presses," BTM Corporation, published prior to Oct. 28, 2015, 40 pages.

* cited by examiner

LINKAGE PRESS MACHINE

CROSS-REFERENCE TO RELATED APPLICATIONS

This application claims the benefit of U.S. Provisional Application No. 62/259,697, filed Nov. 25, 2015, which is incorporated by reference herein.

BACKGROUND AND SUMMARY

The present invention relates generally to press machines and more particularly to a linkage operated press.

Presses for stamping and piercing sheet metal are well known. Conventional presses typically are driven by a large hydraulic piston, vertically oriented screws rotated by electric motors, or crankshafts, in combination with toggle linkage mechanisms. Examples of these conventional presses are disclosed in the following U.S. Pat. No. 7,810,368 entitled "Multi-Mode Hammering Machine" which issued to Rusch on Oct. 12, 2010; U.S. Pat. No. 6,510,786 entitled "Hydromechanical Press Drive" which issued to Harsch on Jan. 28, 2003; U.S. Pat. No. 4,920,782 entitled "Press Drive" which issued to Hellwig on May 1, 1990; and U.S. Pat. No. 3,763,690 entitled "Press Brake Ram Leveling" which issued to Kirincic et al. on Oct. 9, 1973. All of these patents are incorporated by reference herein.

These conventional presses, however, suffer various deficiencies. For example, they open and close too slowly. Furthermore, traditional hydraulically and motor driven presses often have jerky opening and closing movements which reduces durability. Prior crankshaft and sector gear mechanisms also require custom, and therefore expensive, parts.

In accordance with the present invention, a press machine includes at least one actuator and at least one linkage to open and close a ram. Another aspect employs a sheet metal-working punch mounted to the ram. A fluid-powered piston drives a carriage coupled to a linkage in another aspect of the present machine. In still another aspect, at least a majority of an actuator is located externally to an outside surface of a stationary structure within which a ram is located. Yet a further aspect both opens and closes a ram with a unidirection movement of an actuator. Methods of operating a press are also provided.

The present linkage press machine is advantageous over conventional presses. For example, the present machine operates faster and smoother. Furthermore, standard components can be used to move the present ram, as compared to traditional devices, thereby reducing the expense of manufacturing the present machine. Additional advantages and features of the present machine will become apparent from the following description and appended claims.

DETAILED DESCRIPTION

Figure 1:
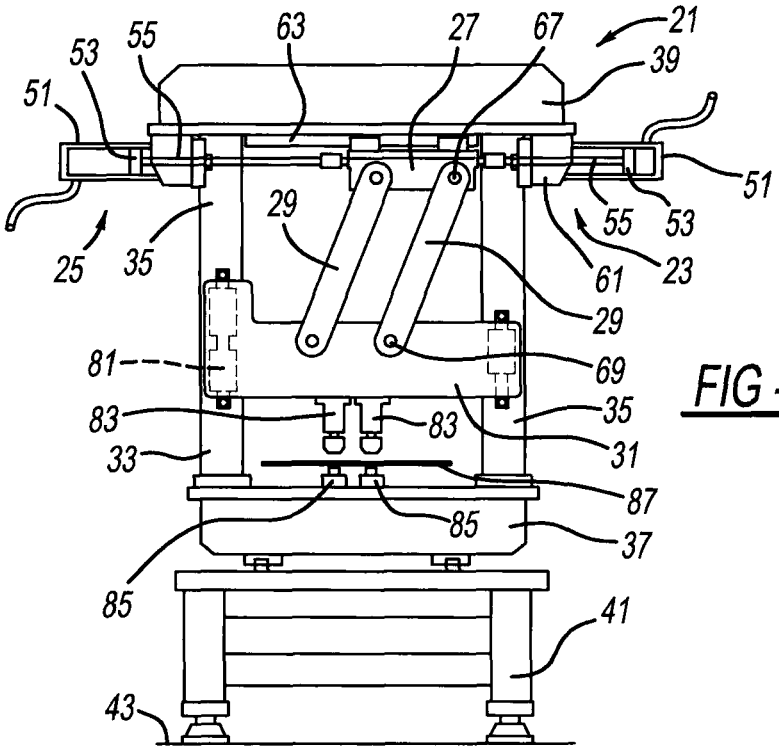
FIG. 1 is a diagrammatic front view showing a first embodiment of the present press machine in a first open position.
Figure 2:
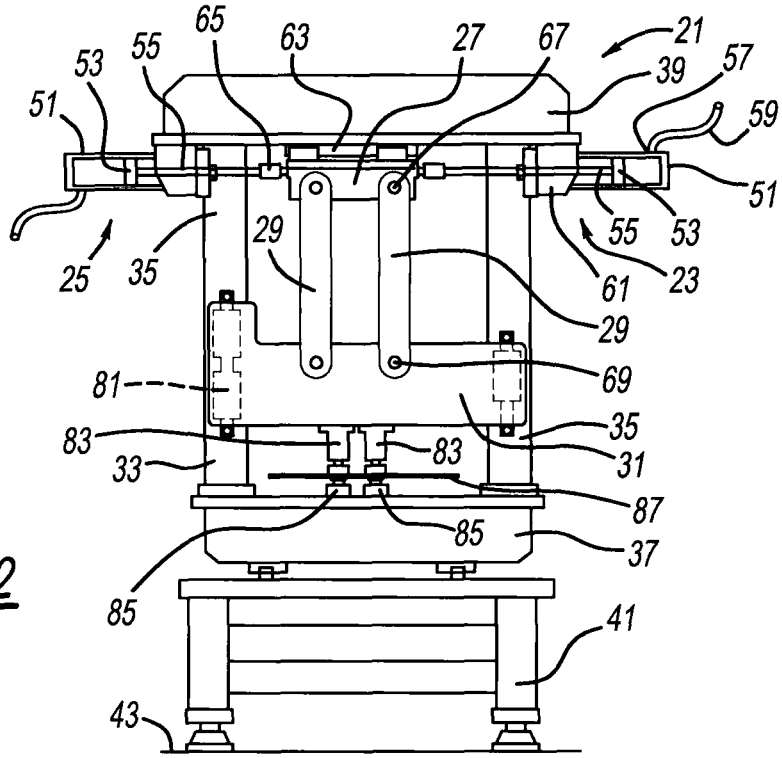
FIG. 2 is a diagrammatic front view showing the first embodiment machine in a closed position.
Figure 3:
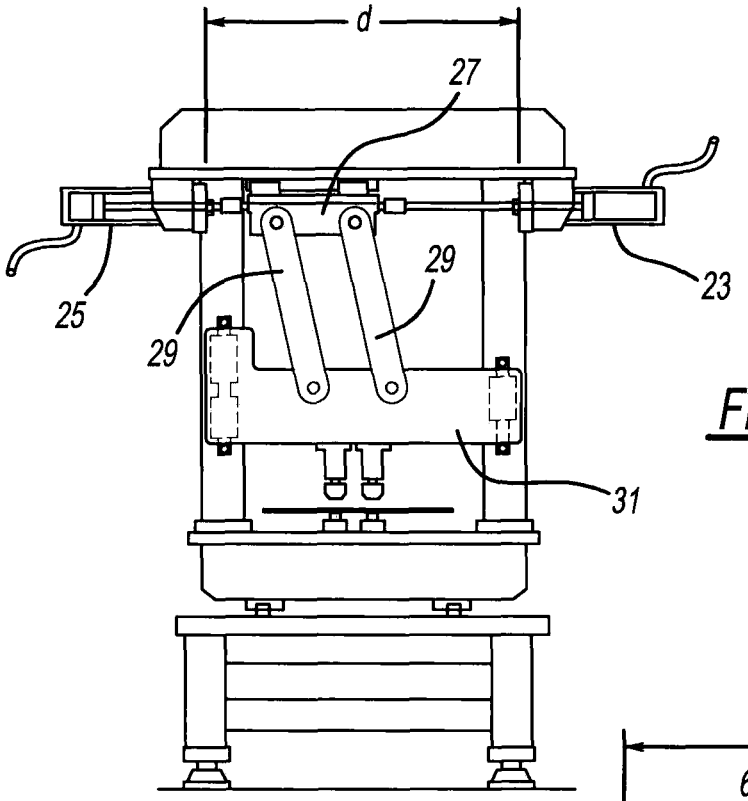
FIG. 3 is a diagrammatic front view showing the first embodiment machine in a second open position.
Figure 4:
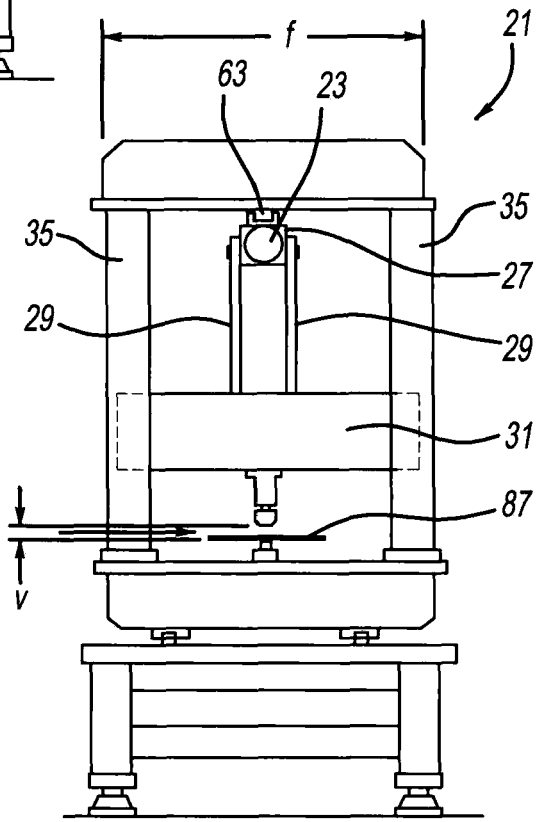
FIG. 4 is a diagrammatic side view showing the first embodiment machine in the open positions.
Figure 5:
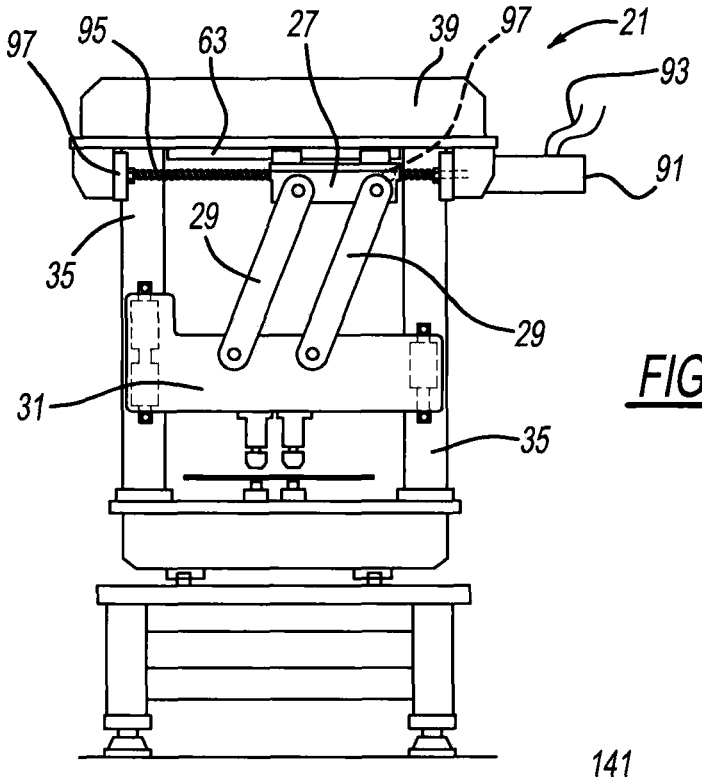
FIG. 5 is a diagrammatic front view showing an electromagnetic actuator construction of the first embodiment machine in the first open position.
Figure 6:
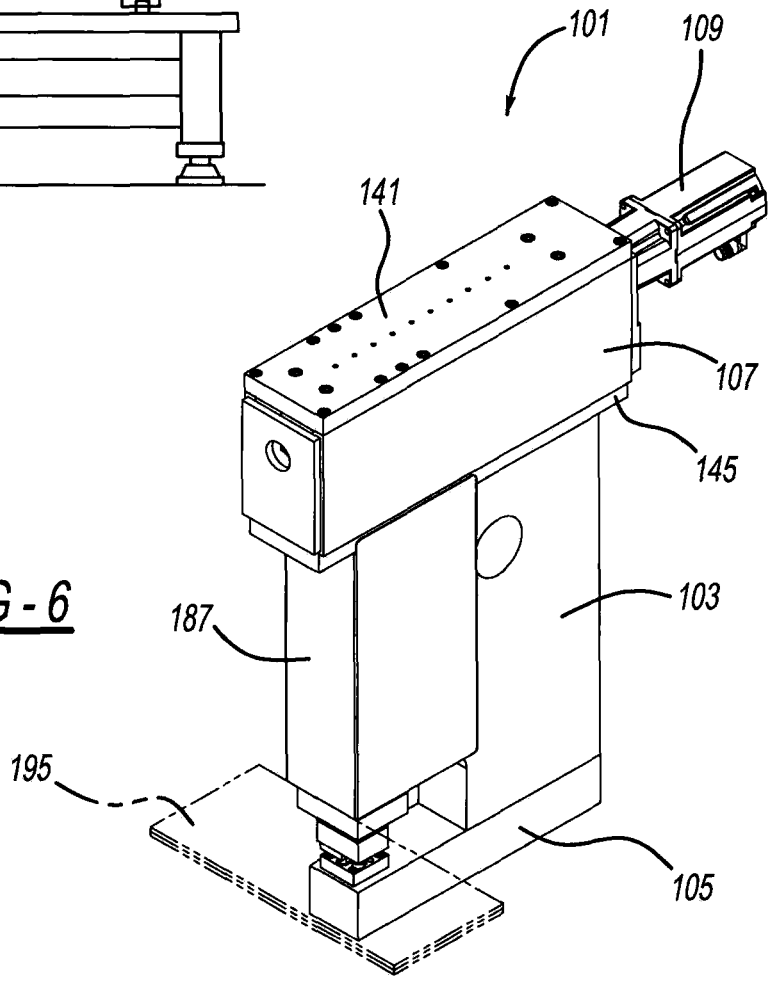
FIG. 6 is a perspective view showing a second embodiment of the present machine.
Figure 7:
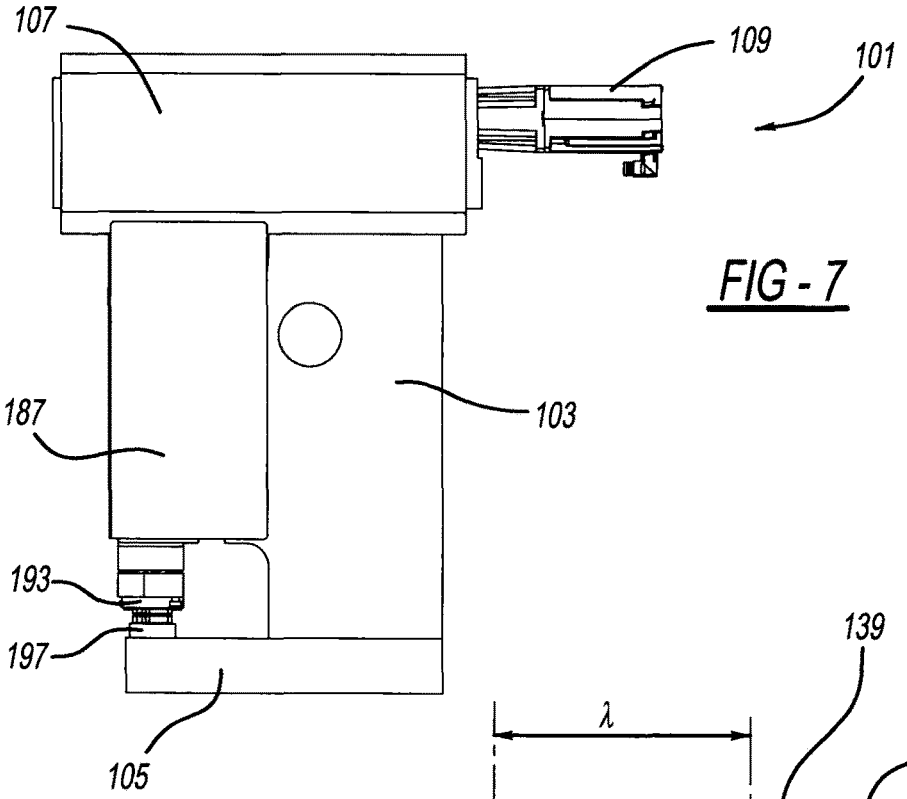
FIG. 7 is a side elevational view showing the second embodiment machine in a closed position.

A first embodiment of a linkage press machine 21 is illustrated in FIGS. 1-4. Machine 21 includes a pair of coaxially aligned fluid-powered actuators 23 and 25, a carriage or slide 27, linkages 29, a ram 31 (also known as a die) and a stationary structure 33. Structure 33 includes four spaced apart corner posts or frames 35 affixed to and spanning between a base 37 and a cap 39. Optionally, a table or support 41 is located between base 37 and a factory floor 43. Adjacent pairs of frames 35 define four generally vertical planes surrounding a periphery of machine 21. Optionally, protective covers may be externally attached to frames 35, in which event, they define the vertical planes. A workpiece feeding direction dimension f is less than a perpendicular dimension d for machine 21.

Each actuator 23 and 25 includes a fluid powered cylinder 51, a piston 53 and a piston rod 55. Hydraulic or pneumatic fluid is pumped into each cylinder at an inlet port 57, via a hose 59, which pushes pistons 53 and their associated rods 55. Fluid on the opposite side of pistons 55 flows out of an outlet port in cylinders 51. A majority of actuators 23 and 25 is located externally to the adjacent outside surfaces defined by the vertical planes of frames 35, and also below a horizontal plane defined by a lower surface of cap 39. A bracket 61 stationarily couples each cylinder 51 to one of the frames 35 and/or cap 39.

An elongated rail 63 is mounted to the bottom surface of cap 39 by screws. Carriage 27 is movably coupled to and rides along a rail 63. Carriage 27 has multiple generally C-shaped fingers extending from a top thereof which slide along but engage with associated undercut channels of rail 63. One or more ball bearing races may be positioned between carriage 27 and rail 63. Both piston rods 55 are coupled to carriage 27 by removable threaded or pinned fittings 65 to allow for maintenance of the components.

Two straight linkages 29 are located on opposite sides of machine 21. Linkages 29 each have only a first pivot 67, adjacent an upper end, and a second pivot 69, adjacent a lower end. Both upper pivots 67 are directly rotatably coupled to carriage 27 and both lower pivots are directly rotatably coupled to ram 31. Of course, bushings, ball bearing races and pivot pins may be employed at the pivot couplings. Linkages 29 define a parallelogram four-bar linkage mechanism, which is mirrored on the opposite side of ram 31. Actuators 23 and 25, carriage 27, and linkages 29 are the sole driving mechanisms for ram 31, without any cams, toggles or levers, thereby creating a simplified, durable and cost effective construction.

Ram 31 is coupled to all four frames 35 via linear, caged ball guides 81. Guides 81 include vertically elongated rails affixed to frames 35 and blocks mounted to sides of ram 31 which slidably mate with the rails. An exemplary guide 81 is a SHS caged ball LM guide which can be obtained from THK Co., Ltd. of Tokyo, Japan.

One or more punches 83 are affixed to a bottom of ram 31 and vertically extend therefrom. One or more upstanding dies 85 are affixed to base 37, aligned with punches 83. Two sets of punches and dies are shown. Punches and dies deform one or more sheet metal workpieces 87, such as by bending, piercing holes and/or by creating interlocking clinch joints to fasten the workpieces together.

Machine 21 operates as follows. First, pistons 53 are internally pushed from one end of their cylinders 51 to the other, from right to left in the exemplary sequence illustrated from FIGS. 1-3. The pistons may both be actively driven in a simultaneous manner or one may be active and the other a passive slave depending on the direction. Advancement of pistons 53 moves piston rods 55, which in turn, moves carriage 27 from right to left. This action rotates linkages 29 thereby vertically advancing ram 31 from its fully open and raised position shown in FIG. 1 to its fully closed and lowered position shown in FIG. 2. Punches 83 and dies 85 deform workpiece(s) 87 in this ram closing operation. Linkages 29 are essentially vertically oriented in an over-center position when ram 31 is closed.

Continued advancement of pistons 53, rods 55 and carriage 27 in this same unidirectional movement (right-to-left as illustrated) further rotates linkages in a counterclockwise direction (as illustrated). This reverses and retracts ram 31 from its closed position (shown in FIG. 2) to its open position (shown in FIG. 3), whereby pistons 53 have reached their end of travel positions opposite those illustrated in FIG. 1. After the first workpiece(s) is removed and a subsequent one is fed in, the fluid power is reversed causing the pistons, carriage and linkages to reverse direction, thereby closing and then reopening the ram.

This open-closed-open movement of ram 31 is a single continuous motion of the pistons, carriage and linkages without any intermediate stoppage. Furthermore, this open-closed-open ram movement preferably occurs within 0.5 second for a vertical distance v of at least one inch. The present driving mechanism provides a very fast and smooth operation, in a very compact machine. Moreover, the driving mechanism achieves a continuously variable transmission of ram power with the maximum force to the ram within the last % inch of the advancing stroke adjacent the over-center linkage orientation.

An alternate construction of machine 21 employs an electromagnetic servomotor actuator 91 connected to a programmable controller via electric wires 93. A helically threaded and horizontally elongated jackscrew 95 is held by brackets 97 between frames 35 and below cap 39. Screw 95 is rotated by an armature and an output shaft of motor actuator 91. An internally threaded ball or nut 97 is enmeshed with screw 95 for linear movement relative to screw 95 when the screw is rotated. Nut 97 is coupled to and prevented from rotating by carriage 27, and thereby serves to linearly move carriage 27, which rotates linkages 29 and moves the ram from its open position, to its closed position and then back to its open position as previously discussed with regard to the fluid powered actuation. The present servomotor actuation preferably employs a 1-10 hp motor and a 8:1 motor-to-screw drive ratio, which are both considerably less than conventional arrangements, thereby allowing for lower cost and non-customized components.

A second embodiment linkage press machine 101 can be observed in FIGS. 6-13. This exemplary machine includes an upstanding tool body 103, a base 105 affixed to the body 103, a box-like tool support 107 mounted to the tool body opposite base 105, an actuator 109 coupled to the support 107, and a transmission mechanism driven by the actuator 109. The transmission mechanism includes a jackscrew 121, a ball or nut 123, a carriage or slide 125, and one or more linkages 127 (two parallel linkages being shown).

Jackscrew 121 is coupled for rotation with an output shaft 129 of actuator 109, which is a servomotor including a rotating armature therein. Jackscrew 121 is held within support 107 by a pair of downwardly extending brackets 131 with internally affixed support bearings 133. Nut 123 has an internal thread which is enmeshed with a helical external thread of jackscrew 121. Flanges of nut 123 are attached to a back edge of carriage 125 by way of screws. An oversized bore 135 of carriage 125 is coaxially aligned with but is clear of jackscrew 121 so that carriage 125 linearly moves with but prevents rotation of nut 123 when actuator 109 rotates the jackscrew. An upper flange of carriage 125 is slidably coupled to an elongated rail through generally C-shaped fingers 139 which engage undercut channels in rail 137. Rail 137 is attached to an upper plate 141 of support 107 by screws, which is also screwed to perpendicularly planar side plates 143 of the support. A lower plate 145, parallel to upper plate 141, of support 107 is mounted to body 103 via screws or may alternately be integrally cast or machined as a single piece with the body.

Each linkage 127 has only two pivots 161 and 163 defined by holes adjacent ends of the linkages with associated bushings 165, pivot pins 167 and pin-fastening clips 169. The linkages are straight. For each linkage 127, pivot 161 rotatably couples an upper end of the link to a section of carriage 125 below jackscrew 121, opposite rail 137. Jackscrew 121, carriage 125 and pivot 161 are always located within support 107 in all operating conditions. Pivot 163 of each linkage is rotatably coupled adjacent an upper end of a linearly movable and vertically elongated ram 181. Accordingly advancement of carriage 125 away from actuator 109 in a generally horizontal direction (from right to left as illustrated) causes linkages 127 to rotate (counterclockwise as illustrated), which in turn, linearly advances ram 181 from the open position shown in FIGS. 9 and 10, to the closed position shown in FIGS. 11 and 12. Reverse rotation of actuator 109 retracts the carriage, linkages and ram back to the open position.

A vertically elongated linear rail 183 is mounted to body 103 by screws. A mating slide 185 is affixed to and moves with ram 181. Slide includes generally C-shaped fingers which slideable mate with undercut channels of rail 183. A protective, sheet metal cover or housing 187 is mounted to body 103 and support 107 to hide ram 181 and the bottom of linkages 127.

One or more vertically elongated metal-working punches 191 (two are shown) are removably affixed to a bottom of ram 181. A stripper 193 that strips a workpiece 195 away from the punches after deformation, may also be optionally present. At least one aligned die 197 (two are shown) is affixed to base 105. The punches and dies may be used to bend, pierce and/or form clinching joints in one or multiples of sheet metal workpieces 195.

Figure 13:
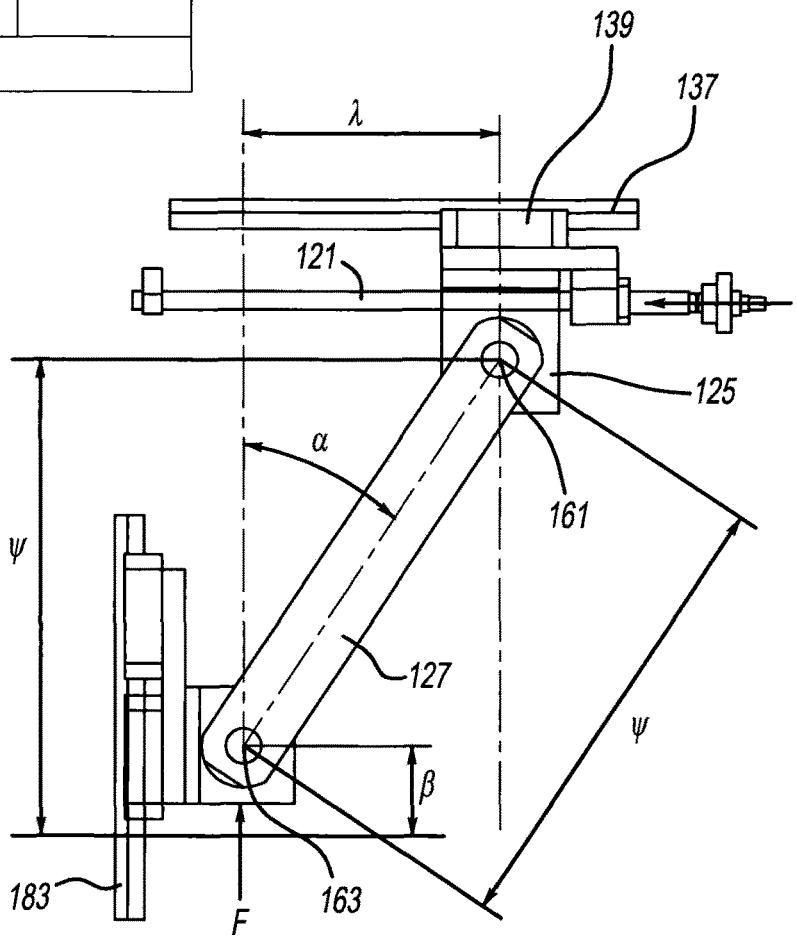
FIG. 13 is a diagrammatic view showing portions of the second embodiment machine in the open position.
Figure 8:
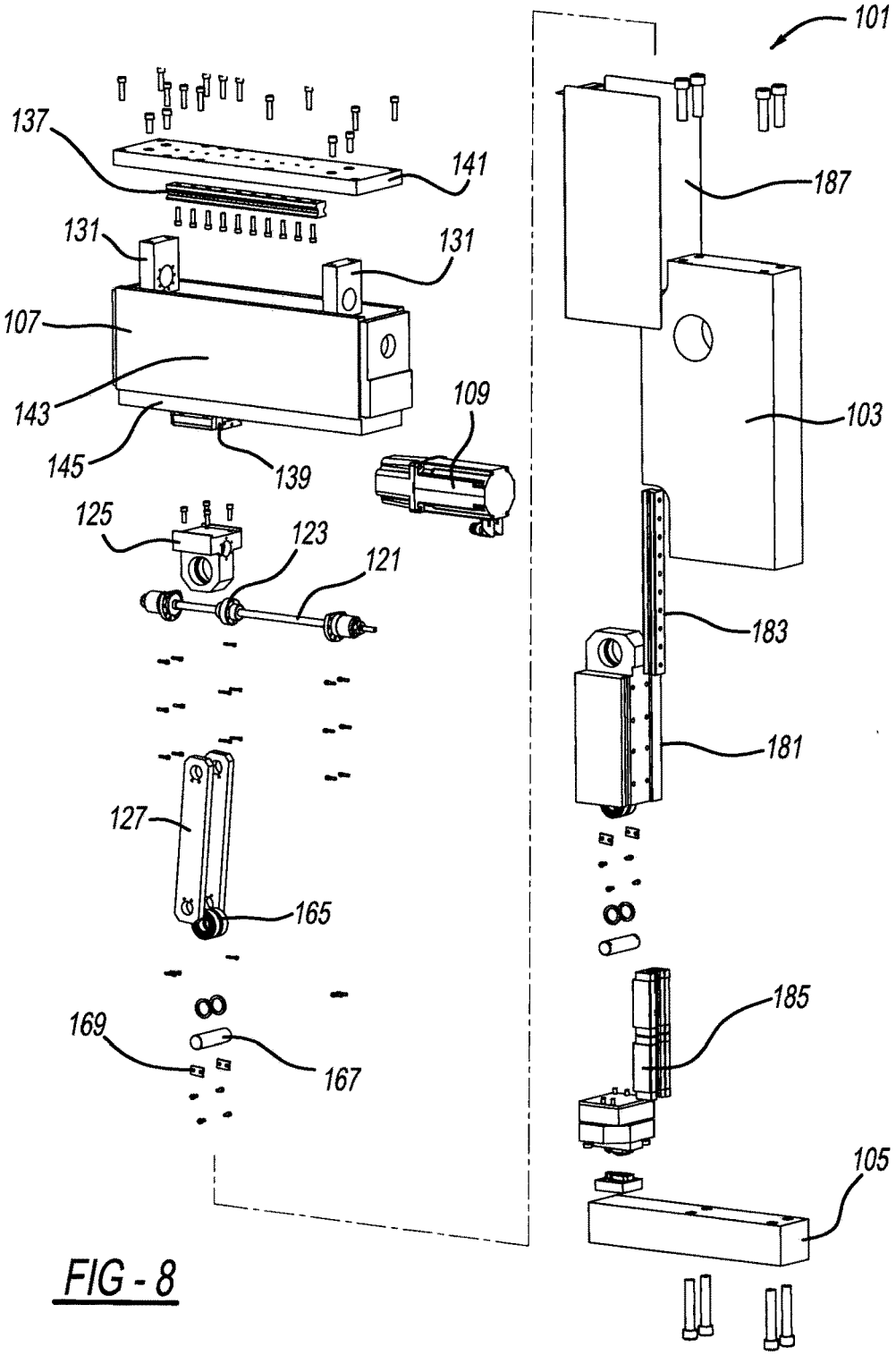
FIG. 8 is an exploded perspective view showing the second embodiment machine.
Figure 9:
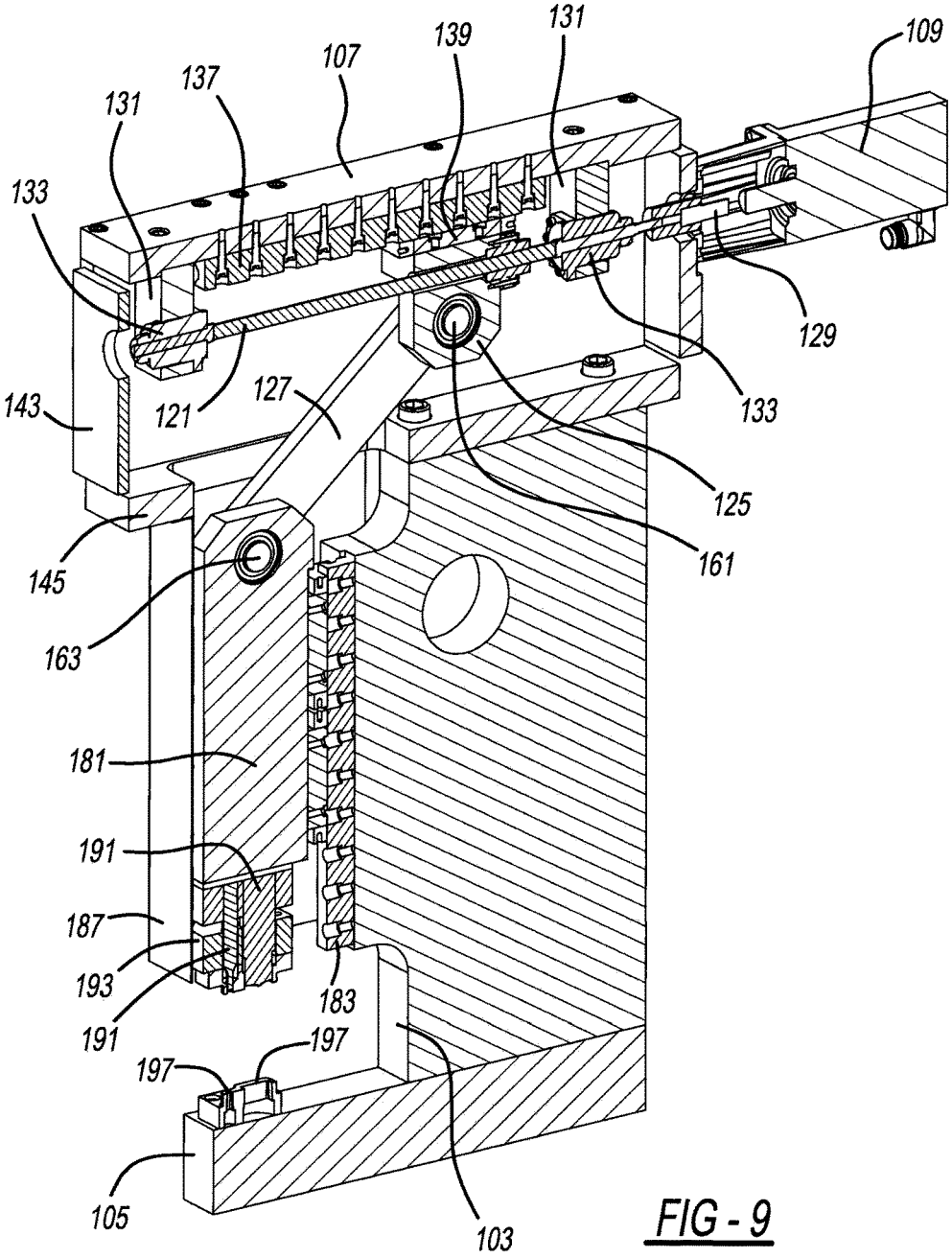
FIG. 9 is a fragmentary perspective view showing the second embodiment machine in an open position.
Figure 10:
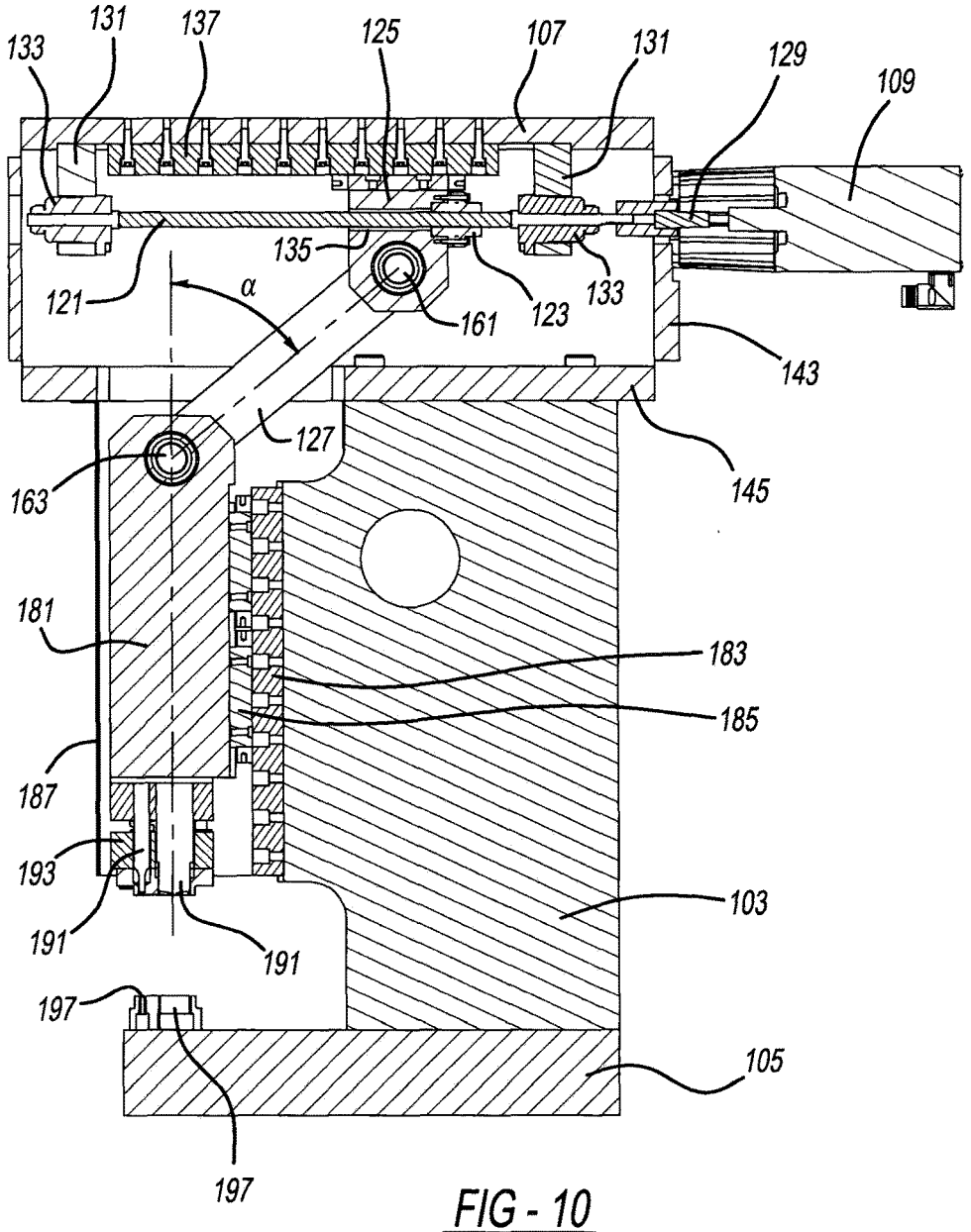
FIG. 10 is a fragmentary elevational view showing the second embodiment machine in the open position.
Figure 11:
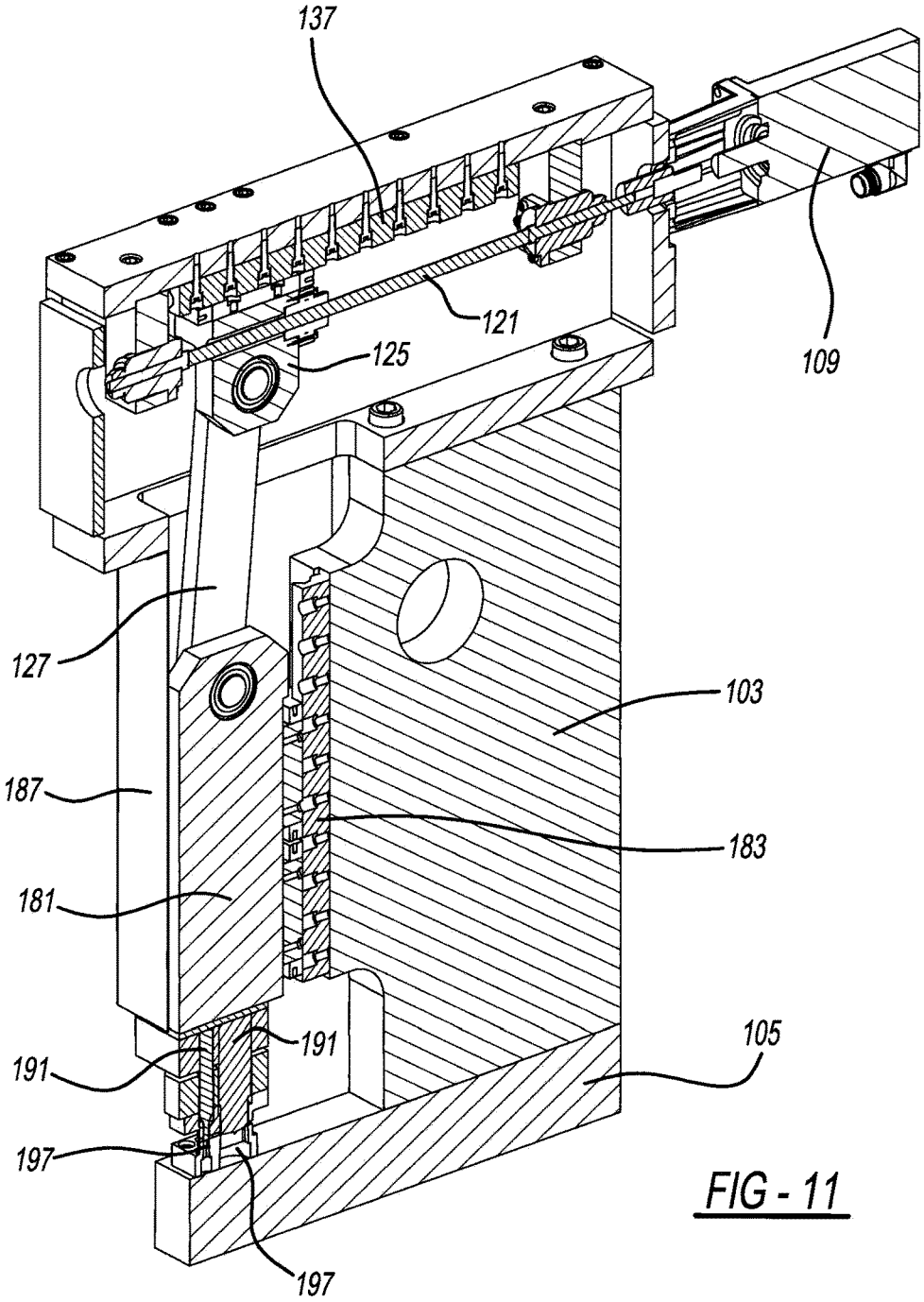
FIG. 11 is a fragmentary perspective view showing the second embodiment machine in the closed position.
Figure 12:
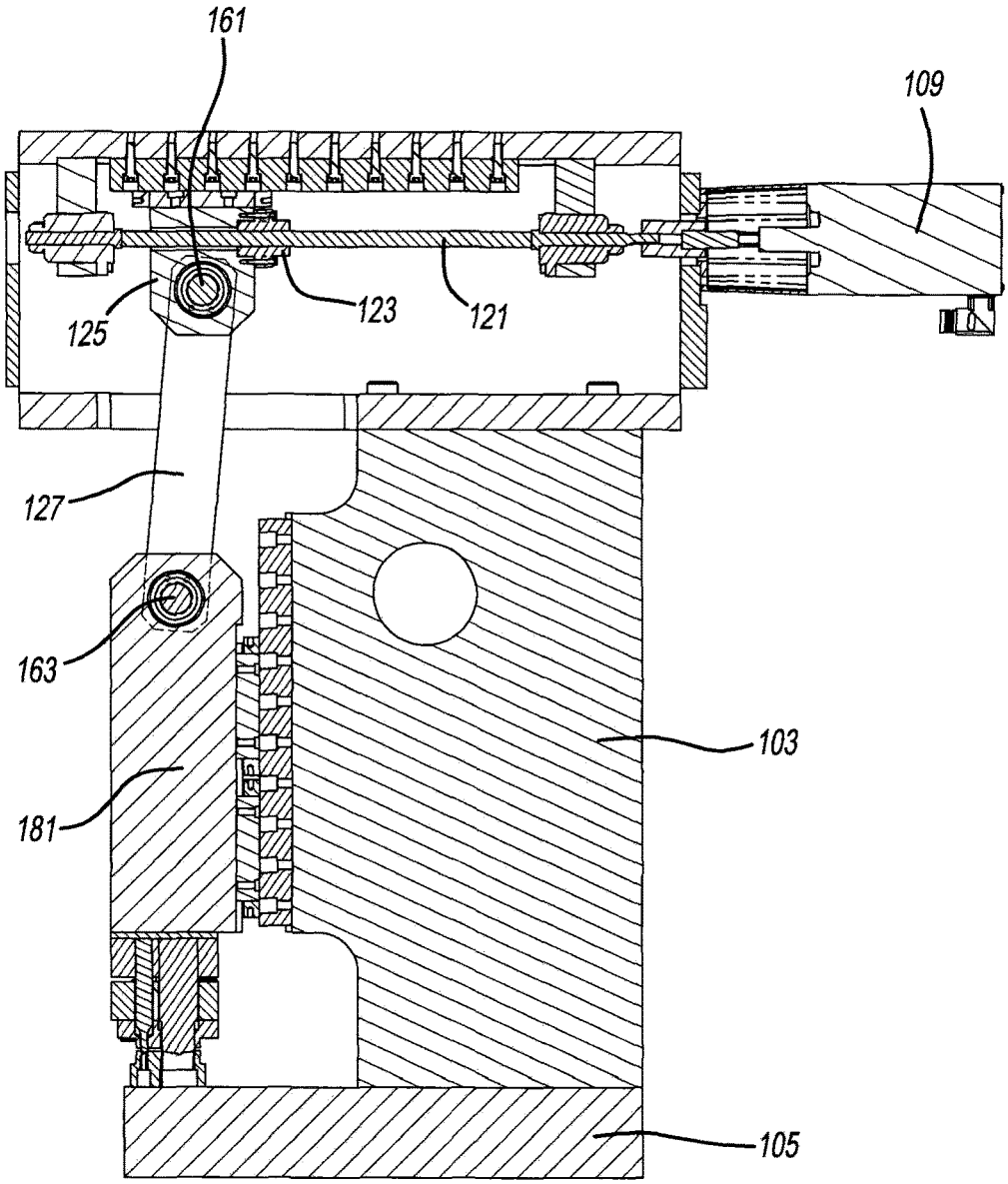
FIG. 12 is a cross-sectional view showing the second embodiment machine in the closed position.

In one exemplary construction of machine 101, as illustrated in FIG. 13, a pivot-to-pivot (161 to 163) dimension ψ of each linkage 127 is 12 inches, and a vertical distance ψ between pivot 161 and β is also 12 inches. A ram height dimension is β, and a center of pivot 163 to retracted end of stroke dimension is λ, a press load or force is F, an actuator input force is I and a linkage angle between fully retracted and theoretically vertical is ∝. Accordingly, in one example, if ∝ is 1°, β is 0.002 inch, λ is 0.21 inch, an output-to-input force ratio is 57.29 (assuming no friction) and a press load F is estimated to be 103,122 pounds. In another example, if ∝ is 10°, β is 0.182 inch, λ is 2.08 inches, an output-to-input force ratio is 5.67 and a press load F is estimated at 10,208 pounds. A further example provides ∝ as 22°, β as 0.874 inch, λ as 4.50 inches, an output-to-input force ratio as 2.48, and a press load F is estimated as 4,455 pounds. These examples assume an actuator input force of 1800 pounds per square inch.

While various embodiments have been disclosed, it should be appreciated that alternate constructions are envisioned. For example, servomotor actuators 91 and 109 may be fluid-rotated actuators. Actuator 109 can alternately be a linear motor or fluid driven cylinder driving a rod or cable instead of a screw and nut, however, certain advantages will not be achieved. Furthermore, different slide and rail components may be employed and differing body, support and structure shaped can be used, but many of the present advantages may not be realized. In another variation, rivets or welds can attach together components in place of the noted screws. It is intended by the following claims to cover these and any other departures from the disclosed embodiments which fall within the true spirit of this invention.

The invention claimed is:

1. A machine comprising:

a stationary structure including substantially vertical outside surfaces;

at least one actuator coupled to the structure with at least a majority of the actuator being located external to the outside surfaces of the structure;

a slide being linearly moveable in a substantially horizontal direction, between the outside surfaces of the structure;

a sheet metal-working press coupled to and moveable relative to the stationary structure; and a linkage having only two pivots, a first of the pivots being directly attached to the slide and a second of the pivots being directly attached to the press;

energization of the actuator operably moving the slide in the substantially horizontal direction which operably rotates the linkage which operably moves the press in a substantially vertical direction;

wherein the at least one actuator causes a single direction movement of the slide from substantially one side of the structure to the other, which in turn, causes the press to move from an open position, to a closed position and back to the open position.

2. The machine of claim 1, wherein the actuator includes a first fluid-powered cylinder with a piston and piston rod moveable therein between advancing and retracting positions along the substantially horizontal direction.

3. The machine of claim 2, further comprising a second fluid-powered cylinder aligned with the first cylinder with a piston moveable therein, the pistons within the first and second cylinders moving in concert with each other when the slide is moved therebetween.

4. The machine of claim 1, wherein the press advances a vertical distance of at least one inch when moving from the fully open position, to the fully closed position and back to the fully open position within 0.5 second.

5. The machine of claim 1, further comprising:

a second linkage directly coupling the slide to the press;

the slide, press and linkages kinematically defining a parallelogram four-bar linkage mechanism on a side of the press offset from the actuator.

6. The machine of claim 1, further comprising a piercing punch is mounted to and moveable with the press to create a hole in a workpiece.

7. The machine of claim 1, further comprising a clinching punch is mounted to and moveable with the press to create an interlocking clinch joint between sheet metal workpieces.

8. The machine of claim 1, wherein the structure comprises spaced apart and vertically elongated frames adjacent corners of the press.

9. A machine comprising:

a stationary structure including substantially vertical outside surfaces;

at least one actuator coupled to the structure with at least a majority of the actuator being located external to the outside surfaces of the structure;

a slide being linearly moveable in a substantially horizontal direction, between the outside surfaces of the structure;

a sheet metal-working press coupled to and moveable relative to the stationary structure; and a linkage having only two pivots, a first of the pivots being directly attached to the slide and a second of the pivots being directly attached to the press;

energization of the actuator operably moving the slide in the substantially horizontal direction which operably rotates the linkage which operably moves the press in a substantially vertical direction;

the stationary structure including a substantially C-shaped frame;

the press being a ram elongated in its direction of vertical movement; and the linkage and the slide being always entirely enclosed within the frame.

10. The machine of claim 9, wherein the frame comprises a cast or machined metal body, a hollow housing within which the slide moves, and a base upon which a die is secured.

11. The machine of claim 9, wherein the press advances a vertical distance of at least one inch when moving from the fully open position, to the fully closed position and back to the fully open position within 0.5 second.

12. The machine of claim 9, wherein the actuator includes a first fluid-powered cylinder with a piston and piston rod moveable therein between advancing and retracting positions along the substantially horizontal direction.

13. A machine comprising:

a stationary structure including substantially vertical outside surfaces:

at least one actuator coupled to the structure with at least a majority of the actuator being located external to the outside surfaces of the structure;

a slide being linearly moveable in a substantially horizontal direction, between the outside surfaces of the structure;

a sheet metal-working press coupled to and moveable relative to the stationary structure;

a linkage having only two pivots, a first of the pivots being directly attached to the slide and a second of the pivots being directly attached to the press:

energization of the actuator operably moving the slide in the substantially horizontal direction which operably rotates the linkage which operably moves the press in a substantially vertical direction; and a jack-screw extending in the substantially horizontal direction between the outside surfaces of the structure, and the slide enmeshing with and moving along the jack-screw in response to the energization of the actuator which is an electric motor.

14. The machine of claim 13, wherein the at least one actuator causes a single direction movement of the slide from substantially one side of the structure to the other, which in turn, causes the press to move from an open position, to a closed position and back to the open position.

15. The machine of claim 13, wherein the press advances a vertical distance of at least one inch when moving from the fully open position, to the fully closed position and back to the fully open position within 0.5 second.

16. A machine comprising:

a metal-working press;

multiple fluid-powered pistons coaxially aligned with each other;

at least one piston rod extending between the pistons;

at least one slide movable between the pistons in response to movement of the piston rod;

multiple parallel linkages coupling the at least one slide to the press;

linear movement of the pistons along solely a first direction operably causing the slide to linearly move in the first direction, which operably rotates the linkages, which both linearly advances and retracts the press along an axis substantially perpendicular to the first direction; and reverse linear movement of the pistons along solely a second direction opposite to the first direction operably causes the slide to linearly move in the second opposite direction, which operably reverse rotates the linkages, which both linearly advances and retracts the press along the axis.

17. The machine of claim 16, wherein the pistons are pneumatically moved, and a majority of fluid cylinders within which each of the pistons are located, are external to substantially vertical side planes of the press.

18. The machine of claim 16, wherein the pistons are hydraulically moved, and a majority of fluid cylinders within which each of the pistons are located, are external to substantially vertical side planes of the press.

19. The machine of claim 16, wherein the press advances a vertical distance of at least one inch when moving from the open position, to the closed position and back to the open position within 0.5 second.

20. The machine of claim 16, further comprising a piercing punch is mounted to and moveable with the press to create a hole in a workpiece.

21. The machine of claim 16, further comprising a clinching punch is mounted to and moveable with the press to create an interlocking clinch joint between sheet metal workpieces.

22. The machine of claim 16, wherein the linkages define a parallelogram four-bar linkage mechanism on a side of the press offset from sides adjacent to which piston cylinders are mounted.

23. The machine of claim 16, further comprising:

a sheet metal workpiece located between a punch, mounted to the press, and a stationary die aligned with the punch; and a workpiece feeding direction dimension f of the press is less than a dimension d of the press perpendicular thereto, the pistons being inside of cylinders, and each of the cylinders being mounted on a narrower side of the press.

24. A machine comprising:

a metal-working press;

an actuator operably driving at least one carriage along a first linear axis; and multiple linkages each having only two pivots, a first of the pivots of each linkage being attached to the at least one carriage, and a second of the pivots of each linkage being attached to the press;

when operating, unidirectional movement of the at least one carriage along the first linear axis rotates the linkages which causes both advancing and retracting of the press along a second linear axis substantially perpendicular to the first linear axis;

wherein the press advances a vertical distance of at least one inch when moving from the open position, to the closed position and back to the open position within 0.5 second.

25. The machine of claim 24, wherein the linkages define a parallelogram four-bar linkage mechanism on a side of the press offset from the actuator.

26. The machine of claim 24, wherein the actuator includes a first fluid-powered cylinder with a piston and piston rod moveable therein between advancing and retracting positions along a substantially horizontal direction.

27. A machine comprising:

a metal-working press;

an actuator operably driving at least one carriage along a first linear axis;

multiple linkages each having only two pivots, a first of the pivots of each linkage being attached to the at least one carriage, and a second of the pivots of each linkage being attached to the press;

when operating, unidirectional movement of the at least one carriage along the first linear axis rotates the linkages which causes both advancing and retracting of the press along a second linear axis substantially perpendicular to the first linear axis; and a piercing punch mounted to and moveable with the press to create a hole in a workpiece.

28. The machine of claim 27, wherein the actuator includes a first fluid-powered cylinder with a piston and piston rod moveable therein between advancing and retracting positions along a substantially horizontal direction.

29. A machine comprising:

a metal-working press;

an actuator operably driving at least one carriage along a first linear axis;

multiple linkages each having only two pivots, a first of the pivots of each linkage being attached to the at least one carriage, and a second of the pivots of each linkage being attached to the press;

when operating, unidirectional movement of the at least one carriage along the first linear axis rotates the linkages which causes both advancing and retracting of the press along a second linear axis substantially perpendicular to the first linear axis; and a clinching punch mounted to and moveable with the press to create an interlocking clinch joint between sheet metal workpieces.

30. The machine of claim 29, wherein the actuator includes a first fluid-powered cylinder with a piston and piston rod moveable therein between advancing and retracting positions along a substantially horizontal direction.

31. A machine comprising:

a metal-working press;

at least one carriage;

multiple linkages each having only two pivots, a first of the pivots of each linkage being attached to the at least one carriage, and a second of the pivots of each linkage being attached to the press, and the linkages defining a parallelogram four-bar linkage mechanism on a side of the press offset from the actuator;

when operating, unidirectional movement of the at least one carriage along the first linear axis rotates the linkages which causes both advancing and retracting of the press along a second linear axis substantially perpendicular to the first linear axis; and a second fluid-powered cylinder aligned with a first fluid-powered cylinder, pistons within the first and second cylinders moving in concert with each other when the at least one carriage is linearly moved therebetween.

32. A machine comprising:

a metal-working press;

an electric motor operably driving at least one carriage along a first linear axis;

multiple linkages each having only two pivots, a first of the pivots of each linkage being attached to the at least one carriage, and a second of the pivots of each linkage being attached to the press;

when operating, unidirectional movement of the at least one carriage along the first linear axis rotates the linkages which causes both advancing and retracting of the press along a second linear axis substantially perpendicular to the first linear axis; and a jack-screw extending in the substantially horizontal direction between vertical planes defined by outside surfaces of the press, and the at least one carriage enmeshing with and moving along the jack-screw in response to the energization of the electric motor.

33. The machine of claim 32, wherein the press advances a vertical distance of at least one inch when moving from the open position, to the closed position and back to the open position within 0.5 second.

34. A machine comprising:

an upstanding tool body;

a base coupled to the tool body;

a metal-working die attached to the base;

a tool support coupled to the tool body opposite the base;

an electric motor attached to the tool support;

a jack-screw rotatable by the electric motor;

a carriage enmeshed with the jack-screw;

a linkage being rotatable in response to linear movement of the carriage;

a ram being linearly advanceable due to rotation of the linkage, a linear advancing direction of the ram being substantially perpendicular to an elongated axis of the jack-screw; and a metal-working punch coupled to the ram and being aligned with the die.

35. The machine of claim 34, wherein:

the carriage is an internally threaded nut;

a rotational axis of the electric motor is coaxial with the axis of the jack-screw; and the tool support includes a hollow housing within which is the jack-screw and nut.

36. The machine of claim 35, further comprising a shield mounted to the tool body, the ram being moveable within the shield, and the linkage being hidden within at least one of the housing and the shield.

37. The machine of claim 34, wherein the linkage has only two pivots, a first of the pivots is directly coupled to the ram and a second of the pivots is directly coupled to a slide that linearly moves with the carriage.

38. The machine of claim 34, wherein the punch and the die pierce a workpiece hole.

39. The machine of claim 34, wherein the punch and the die clinch together workpieces with an interlocking joint.

40. A method of operating a sheet metal-working press, the method comprising:

(a) energizing multiple actuators which coaxially align on opposite sides of the press;

(b) linearly and unidirectionally advancing a slide between the actuators in a first direction in response to step (a);

(c) rotating a four-bar linkage mechanism in response to step (b);

(d) advancing and retracting the press through the linkage mechanism rotation in response to the unidirectionally advancing of step (b);

(e) deforming a sheet metal workpiece by at least one of: (i) piercing, and (ii) clinching, in response to step (d); and (f) retracting the member in a second direction opposite the first direction.

41. The method of claim 40, wherein the energizing includes supplying fluid against a piston of the actuator.

42. A method of operating a sheet metal-working press, the method comprising:

(a) energizing an electric motor:

(b) linearly and unidirectionally advancing a member in a first direction in response to step (a):

(c) rotating a four-bar linkage mechanism in response to step (b) (d) advancing and retracting the press through the linkage mechanism rotation in response to the unidirectionally advancing of step (b):

(e) deforming a sheet metal workpiece by at least one of: (i) piercing, and (ii) clinching, in response to step (d):

(f) retracting the member in a second direction opposite the first direction;

(g) the electric motor rotating a jack-screw which moves the member enmeshed therewith, the member being at least one of: a slide or an internally threaded nut.

* * * * *